US011363864B2

(12) United States Patent
Clarke

(10) Patent No.: US 11,363,864 B2
(45) Date of Patent: Jun. 21, 2022

(54) SUPPORT ASSEMBLY FOR INDOOR AND OUTDOOR USE

(71) Applicant: Dougan H. Clarke, Miami, FL (US)

(72) Inventor: Dougan H. Clarke, Miami, FL (US)

(73) Assignee: TUUCI WORLDWIDE, LLC, Miami-Hialeah, FL (US)

( * ) Notice: Subject to any disclaimer, the term of this patent is extended or adjusted under 35 U.S.C. 154(b) by 0 days.

(21) Appl. No.: 16/915,076

(22) Filed: Jun. 29, 2020

(65) Prior Publication Data

US 2021/0401133 A1 Dec. 30, 2021

(51) Int. Cl.

| | |
|---|---|
| ***A45B 25/02*** | (2006.01) |
| ***A45B 25/06*** | (2006.01) |
| ***E04C 3/29*** | (2006.01) |
| *E04C 3/04* | (2006.01) |

(52) U.S. Cl.

CPC ..... *A45B 25/06* (2013.01); *A45B 25/02* (2013.01); *E04C 3/29* (2013.01); *E04C 2003/043* (2013.01)

(58) Field of Classification Search

CPC ..... A45B 1/00; A45B 2009/005; A45B 15/60
USPC ..... 29/897.33; 52/836, 843
See application file for complete search history.

(56) References Cited

U.S. PATENT DOCUMENTS

| | | | | |
|---|---|---|---|---|
| 127,047 A | | 5/1872 | Griffenberg | |
| 839,189 A | | 12/1906 | Oberbeck | |
| 2,834,073 A | | 5/1958 | Hoyle, Jr. | |
| 2,848,769 A | | 8/1958 | Oakley | |
| 3,462,110 A | * | 8/1969 | Cheslock | E04H 12/08 248/219.4 |
| 3,972,529 A | * | 8/1976 | McNeil | A63B 53/12 473/320 |
| 4,142,343 A | * | 3/1979 | Trafton | E04H 17/20 248/219.1 |
| 4,194,338 A | * | 3/1980 | Trafton | E04H 12/2223 256/65.03 |
| 4,493,172 A | * | 1/1985 | Jones | E04B 2/7845 52/220.1 |
| 4,895,332 A | * | 1/1990 | Hansen | A47K 3/003 248/251 |

(Continued)

FOREIGN PATENT DOCUMENTS

| | | |
|---|---|---|
| AU | 2004201611 | 11/2005 |
| EP | 3932247 | 1/2022 |

*Primary Examiner* — Noah Chandler Hawk
(74) *Attorney, Agent, or Firm* — Malloy & Malloy, PL; Jennie S. Malloy; Peter A. Matos

(57) ABSTRACT

The present invention is directed to improvements of a support assembly having a versatile structure capable of use with a variety of different products, devices, etc. intended for outdoor and/or indoor use such as, but not limited to, furniture, and/or umbrella or shade structures. The support assembly includes a body having a plurality of connector structures fixedly connected in outwardly extending, collectively surrounding relation thereto. The connector structures movably and removably interconnect one or more inserts in overlying relation to an outer surface of the body. When the body defines a support pole for an umbrella assembly, the plurality of connectors extend outwardly from the inserts in movable engagement with a canopy activating hub, thereby maintaining a spacing between the hub and the inserts, concurrent to travel of the hub along the length of the body.

16 Claims, 6 Drawing Sheets

(56) References Cited

U.S. PATENT DOCUMENTS

| | | | | |
|---|---|---|---|---|
| 5,175,971 | A * | 1/1993 | McCombs | E04H 12/02 52/843 |
| 5,513,477 | A | 5/1996 | Farber | |
| 5,979,119 | A * | 11/1999 | Trafton | E04B 1/2403 52/40 |
| 6,851,838 | B2 | 2/2005 | Haddad et al. | |
| 7,063,096 | B2 * | 6/2006 | Stoeckler | E04H 15/46 135/114 |
| 7,124,694 | B2 | 10/2006 | Li | |
| 7,530,540 | B2 * | 5/2009 | Long | E04B 2/7444 248/230.1 |
| 2009/0025764 | A1 * | 1/2009 | Lee | A45B 25/02 135/27 |

* cited by examiner

SUPPORT ASSEMBLY FOR INDOOR AND OUTDOOR USE

BACKGROUND OF THE INVENTION

Field of the Invention

This invention is directed to a versatile support assembly which may be incorporated in a variety of different structures, products, components, etc. and may be usable in both an indoor and an outdoor environment. In at least one embodiment, the inventive support assembly is incorporated into a large outdoor umbrella assembly, and comprises a support pole having an elongated body that includes a plurality of connector structures connecting one or more inserts in overlying relation to an outer surface of the elongated body. Another aspect of the invention is that the inserts may themselves have various decorative features and be removable from the elongated body.

Description of the Related Art

A variety of different structures, products, components, etc. are made and structured for use in either an indoor or an outdoor environment. However, relatively few of such structures are suitable for ongoing use in both indoor and outdoor environments. For example, indoor furniture is usually quite different in design, configuration and materials used from that outdoor furniture. Further, the decorative features of indoor and outdoor furniture and other related products may also vary dependent, at least in part, on where they are intended for use, exposure to weather conditions, and the like.

By way of example, outdoor umbrellas are designed and structured for both practical and decorative applications and can typically be located in a variety of outdoor environments. Umbrellas in this category are usually much larger than a conventional handheld umbrella and are commonly found in different public and private locations such as, but are not limited to, outdoor spaces and decks at restaurants, hotels and other businesses, sidewalk cafés, domestic and commercial swimming pools, as well as a number of other locations that might cater to an outdoor groups of people. These larger outdoor umbrellas are primarily structured to provide protection from the sun, but also from other weather conditions including fog or mist, a light rain, etc. In addition, the popularity of these larger, outdoor umbrellas has led to their being offered in a variety of different sizes, shapes and overall design configurations, which enhance the decorative features thereof, while maintaining the protective characteristics.

While differing in size, configuration, etc., the structural and operative features of many outdoor umbrellas normally include a centrally disposed support pole, wherein a lower end thereof is connected to a supporting base or stand or in the alternative, anchored directly to the ground or other supporting surface. The opposite or upper end of the support pole is structured to movably support the umbrella canopy. In turn, the canopy includes a plurality of activating and supporting components which typically, comprise a movable hub, a plurality of ribs that usually engage an undersurface of the canopy, and a plurality of struts. The struts serve to movably interconnect the plurality of ribs to the hub and can be manipulated to activate the canopy, i.e., opening or closing it, typically by reciprocal movement of the hub along the length of the support pole. As such, the reciprocal movement (i.e., upwardly and downwardly) of the hub along a portion of the length of the support pole will result in the expansion and opening of the canopy, or a collapsing and closing of the canopy, dependent upon the direction of travel of the hub along the length of the support pole. Therefore, due at least in part to the intended size of the umbrella, for its height and canopy coverage, as well as to the possible weather conditions to which an outdoor umbrella may be subjected, the support pole must be structured and/or formed of a material having sufficient strength to bear the weight of the canopy and such operative components of the umbrella, while disposed in or between one of the aforementioned expanded or collapsed orientations.

In addition, outdoor umbrellas of the type referred to herein may also be structured and designed to include various decorative and aesthetic features affecting the overall appearance particularly of, but not limited to the umbrella canopy. In addition, support poles for outdoor umbrellas are known to be made of metal, whether an extruded aluminum or another metallic material, or other type of relatively high strength material including different types of wood. In most cases, the overall aesthetic look offered by an outdoor umbrella will have taken into consideration the appearance of the support pole and how to make the materials used to form it complimentary with the umbrella canopy and other visible structure, so as to enhance the overall decorative features of the umbrella and the canopy associated therewith.

While many individuals consider wood to be aesthetically attractive for use as a support pole, there may be disadvantages to using wood. This includes the expense, as real wood can be expensive and difficult to source, depending on the type of wood, and labor intensive to form and/or apply. In addition, wood also deteriorates in certain conditions, such as by getting wet from rain, as well as from repeated expansion and contraction when exposed to warm and cool temperatures, which can happen in a single day and also across a stretch of several days. Over time then, a support pole made of or with wood may have a reduction in strength and overall structural integrity, as compared to a support pole formed from metal, aluminum, a composite or other high strength material.

Therefore, there is a need for a new and improved support assembly which can be used as a support component in a variety of different products, structures, components, etc. Further, it would be an advantage, if any such support assembly were developed, to also be capable of being incorporated into different products, structures, etc. which in turn, may be used in either an indoor environment or an outdoor environment, or both. In addition, if any such support assembly were developed it would preferably also include variable decorative features such as, but not limited to, providing the appearance of different types of wood or other aesthetically pleasing materials.

Moreover, if any such support assembly were developed, it would ideally also be capable of use as a support pole for outdoor umbrellas, with some ability to allow for changing the aesthetic appearance in a relatively simple manner. Similarly, the ability to replace certain parts of the any such support assembly would also facilitate repair, when needed.

Finally, if any such support assembly were developed, it should further be capable of being manufactured and assembled at a reasonable cost, thereby enhancing its versatility by facilitating its integration into a variety of different structures, components, including various types of outdoor furniture and products, including but not limited to, large outdoor umbrellas, cabanas, shade structures, as well as indoor and outdoor furniture such as tables, chairs, chaises, and the like.

SUMMARY OF THE INVENTION

The present invention is intended to provide a versatile solution to these and other needs which remain in this field of art. As such, the present invention is primarily directed to a support assembly, which may include variable decorative features, and which includes sufficient structural and operational versatility that it can be integrated into a variety of different structures. In more specific terms, the support assembly of the present invention can be used as a supporting component in different structures, products, components, devices, etc. which in turn, can be used in either an indoor environment or outdoor environment.

For purposes of clarity and consistency, the support assembly of the present invention will be explained in greater detail hereinafter as being incorporated within a support pole for an outdoor umbrella assembly. However, its utilization as an umbrella support pole is provided and described herein as a non-limiting example. It is emphasized that the support assembly of the present invention can be utilized with a variety of different structures, products, components and devices. and may include structural modifications with regard to size, configuration and materials from which it is formed. Further by way of example, the different structures in which the support assembly of the present invention may be integrated as a supporting component may include furniture intended for an outdoor environment or an indoor environment or both, and may include tables, chairs, support stands, desks, cabinetry, etc. Also, the versatility of the support assembly of the present invention allows it to be used as a supporting component for outdoor umbrellas, cabanas, and different shade structures, etc.

Therefore, by way of example only, the support assembly of the present invention may be structured to define a support pole for an outdoor umbrella assembly, of the type having a canopy to provide shade from the sun and some protection from other elements. As explained in greater detail hereinafter, the outdoor umbrella assembly can include a movable hub which travels along a length of the support pole, to activate the umbrella canopy, along with associated structure, between an outwardly extended, open and expanded orientation and collapsed and closed orientation. Disposition of the umbrella canopy between the open and closed orientations is accomplished by movement of the hub upwardly or downwardly along a portion of the length of the support pole. Again, however, inventive features described herein for the support pole of an umbrella assembly can also be readily applied and used on other types of support structures, such as the stanchions, support columns and/or beams of outdoor cabanas, as well as those various types of furniture.

In accordance with the exemplary embodiment of an outdoor umbrella, the support pole includes an elongated body that may, but does not have to, extend along the entire length of the support pole. The elongated body may be formed from various materials and by various manufacturing techniques, with a goal of having sufficient strength and rigidity to support the umbrella canopy and associated operative components, in different weather conditions. As such, the body may be formed from an extruded aluminum material or from a variety of other materials having sufficient strength to support the remainder of the umbrella assembly, even during less than desirable weather conditions. Also, the shape of the support pole may vary from an elongated cylindrical configuration with a substantially circular exterior surface and cross-section, to a curvilinear exterior surface and cross-section that varies from a precise circle. As such, the elongated body thereof may have a multi-sided exterior surface configuration and cross-section other than just a circular round one.

Therefore, in the embodiments wherein the support assembly structurally and operationally defines the support pole of an umbrella assembly, a plurality of connector structures are secured to the exterior surface thereof. Moreover, the connector structures are disposed on the elongated body so as to be integral therewith or may be fixedly secured thereto, and extend radially outward from the outer surface thereof. The connector structures are also disposed in spaced relation to one another and in collectively surrounding relation to the elongated body. In at least one embodiment, the plurality of connector structures are preferably, but not necessarily, equally spaced from one another and extend along at least a portion of the length of the support pole body.

Further in accordance with the present invention, the elongated body of the support pole includes at least one, but preferably and more practically, a plurality of inserts disposed in overlying at least partially covering relation to the outer surface of the body. In such an operative disposition, the one or more inserts at least partially define an outer facing of the support pole. Moreover, the one or more inserts are disposed on the body so as to be between a pair of the plurality of connectors, and preferably, in close interconnecting relation, so as to offer a support pole having a finished decorative appearance. Therefore, when a plurality of inserts are disposed in an operative disposition, overlying the outer surface of the body, they may be formed of a common material and have a substantially common decorative appearance. The plurality of inserts can be formed in whole or in part from different types of materials such as woods, veneers, metals, plastics, composites, polymers, etc. or combinations thereof, some or all of which may be decorative, aesthetically pleasing and/or include sufficient structural properties to withstand exposure to the sun and a variety of weather conditions. Alternatively, each of a plurality of inserts may have different, individualized decorative appearances, thereby enhancing the versatility of the aesthetics of the support pole.

As set forth above, the plurality of connector structures may be evenly spaced from one another in collectively surrounding relation to the body. Accordingly, each of the plurality of inserts may also have a substantially common transverse dimension, equal to the spacing between adjacent ones of the plurality of connector structures. As a further advantage, the production cost associated with the plurality of inserts may be reduced, at least partially due to the fact that they have an at least partial common dimension and/or configuration. However, dependent on the configuration of the outer surface and the spacing between the connector structures, at least some of the plurality of inserts to be connected to the body may vary in size and/or shape.

In at least one embodiment of the present invention, each of the plurality of connector structures will preferably also be cooperatively dimensioned, configured and structured with engaging portions for the plurality of inserts to which they are interconnected. For example, the invention may comprise one embodiment wherein the connector structures include a primary segment extending radially outward from an integral connection with the body of the support pole, to an outwardly disposed distal end. Further, the primary segment of the plurality of connector structures may include a lateral segment integrally connected to the primary segment and extending transversely outward therefrom. As a result, each of the plurality of connector structures may have a substantially T-shape or cross-shape as will be described more fully hereinafter. Also, each lateral segment of each of the connector structures will preferably be cooperatively disposed, dimensioned and configured to movably engage a correspondingly disposed peripheral edge portion of the inserts being engaged. Such cooperative structuring between the lateral segment and the corresponding peripheral edges may be at least partially defined by a movable and/or removable tongue and groove connection.

Further, the plurality of inserts may have their longitudinal peripheral edges structured to include an elongated groove cooperatively structured with the outwardly extending lateral segments of the correspondingly disposed connector structures. Cooperative dimensioning between the grooves of the peripheral edges of the inserts and the lateral segments facilitates a sliding movement of the each insert between and in interconnected relation with adjacent ones of the connector structures. Therefore, the aforementioned movable "tongue and groove" connection allows for the insertion and subsequent removal of each of the plurality of inserts in its operative, overlying relation to the exterior surface of the body. In turn, this results in each of the inserts being able to be easily replaced. Such replacement may be the result of damage to the one or more inserts or a desire to change the decorative appearance of the support pole through removal and replacement of the one or more inserts.

As also indicated more in detail herein, in another preferred embodiment of the invention, the primary segment of each of the plurality of connector structures includes a distal end. As such, the length of the primary segment is such as to dispose the distal end thereof outwardly from the outer surface of the body, as well as outwardly from the one or more inserts when operatively mounted on the body. In such an outwardly extending, at least partially protruding disposition, the distal end of each of the primary segments may be disposed in movable engagement with the hub of the umbrella assembly. Such movable engagement between the distal ends of the connector members and the interior surface of the hub serves to dispose and maintain the hub in an outwardly spaced relation to the outer surface of the one or more installed inserts. Therefore, when the canopy is activated due to the movement (upwardly or downwardly) of the hub along the length of the support pole, the distal ends of the plurality of connector structures will movably engage the inner surface of the hub, such that the hub will be continuously spaced outwardly from the exposed exterior surface of the plurality of inserts. Such outward disposition of the hub relative to the exposed surfaces of the plurality of inserts, upon an activation of the canopy between open and closed orientations, will prevent contact between the hub and the inserts and will thereby eliminate or significantly restrict damage, wear, etc. to the outer surface of the inserts, by movement of the hub along the length of the support pole. These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description of the invention, taken in connection with the accompanying drawings in which.

Like reference numerals refer to like parts throughout the several views of the drawings.

DETAILED DESCRIPTION OF THE INVENTION IN ONE OR MORE EMBODIMENTS

Figure 1:
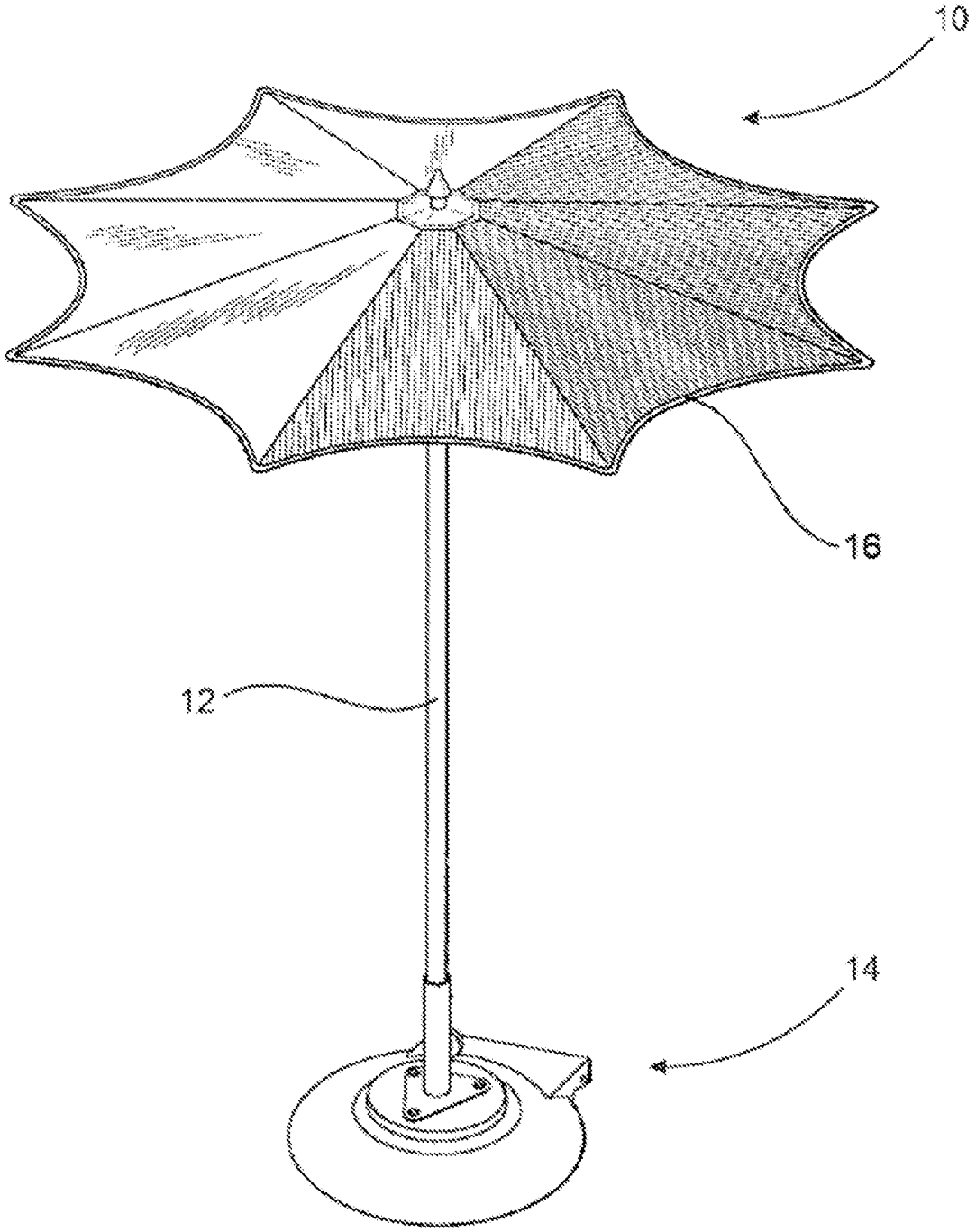
FIG. 1 is a perspective view of an outdoor umbrella assembly of the type usable in combination with the support assembly of the present invention when embodied in the form of a support pole thereof.

As represented in the accompanying Figures, the present invention is directed to a support assembly 12. With specific reference to FIGS. 3, 3A-6 the support assembly 12 and the various components thereof define a versatile structure which may be used in a variety of different structures, products, components, devices, etc. each or at least some of which may be used in both an indoor environment and an outdoor environment. As represented the support assembly 12 may be formed from an extruded aluminum material or from a variety of other materials, formed by a variety of different manufacturing techniques. Also, while the support assembly 12 is represented as an elongated cylindrical configuration having a curvilinear exterior surface, the shape of the support assembly 12 may vary from that represented and vary from an elongated cylindrical configuration with a substantially circular exterior surface and transverse cross-section to a curvilinear exterior surface and cross-section that is other than circular.

For purposes of clarity and consistency the support assembly 12 of the present invention will be described in greater detail hereinafter as being embodied in a support pole, also represented as 12, for an outdoor umbrella generally indicated as 10, of the type represented in FIGS. 1 and 2. Accordingly, the outdoor umbrella assembly 10 typically includes support assembly of FIGS. 3 and 3A as the elongated support pole 12 having a lowermost end thereof commonly secured to a base 14 or other type of support structure or anchor, which is disposed on or in the ground, pavement, floor, or other supporting surface. As also shown in FIG. 1, an uppermost end of the support pole 12 is connected in supporting relation to an umbrella canopy 16.

Figure 2:
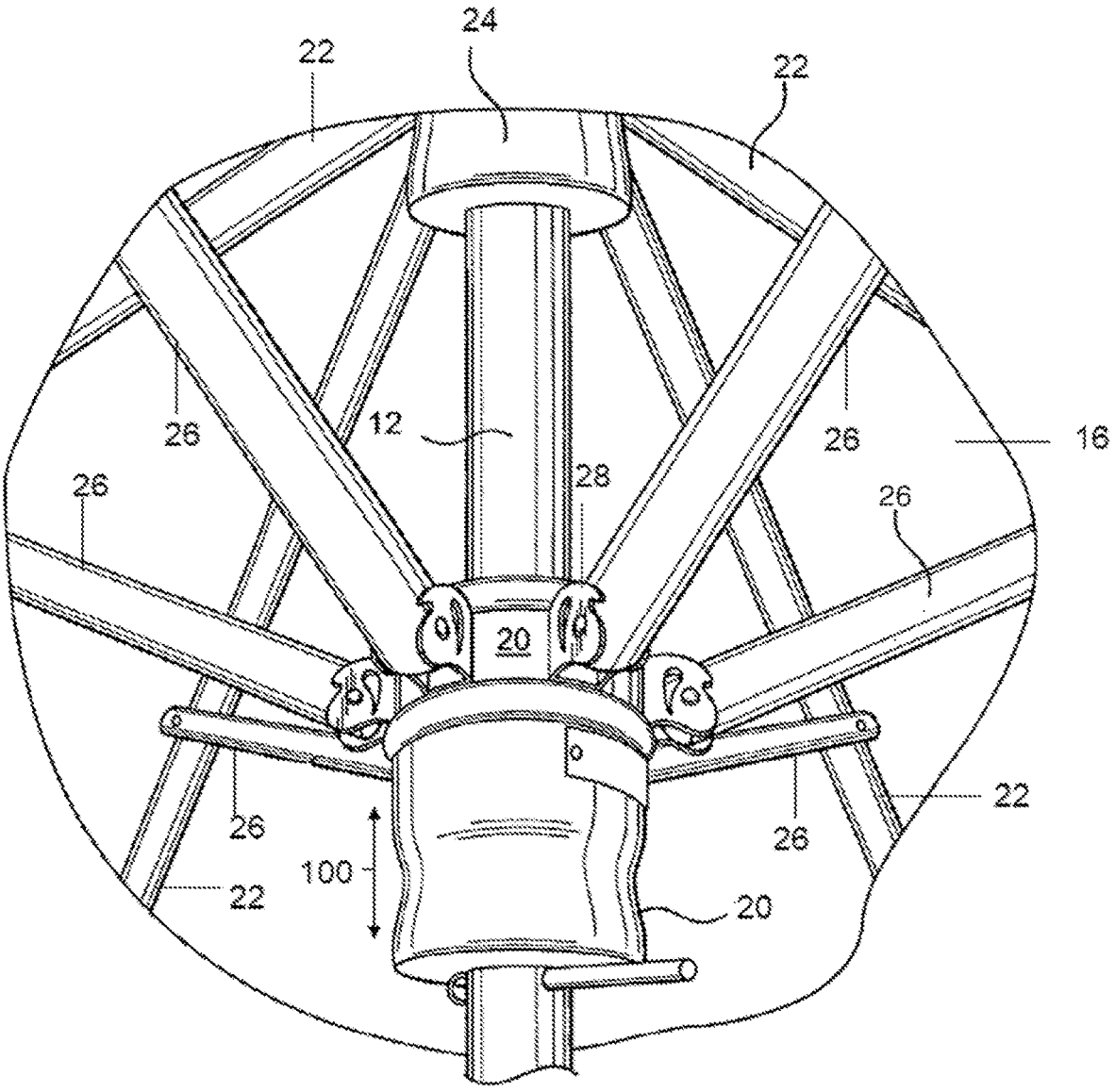
FIG. 2 is a perspective view in detail of a canopy activating hub and associated components of the type usable with the umbrella assembly of the embodiment of FIG. 1 and the support assembly in the form of a support pole of the present invention.

With reference to FIG. 2, the umbrella canopy 16 may be movably mounted on or otherwise connected to the support pole 12. The umbrella canopy is preferably structured and disposed to be movable between an outwardly expanded, open and operable orientation to provide shade and a collapsed, closed orientation for storage purposes when not in use, through movement or travel of a hub 20 along a length of the support pole 12. Accordingly, activation of the canopy 16 between the aforementioned opened or closed orientation comprises movement of the hub 20, typically in a reciprocal fashion, such as upwardly or downwardly, along the length of the support pole 12, as schematically represented by directional arrow 100 in FIG. 2. As is also generally known, activation of the canopy 16 between the open and closed positions is accomplished by a plurality of operative components, including a plurality of ribs 22 engaging an undersurface or other appropriate portion of the canopy 16 and being movably connected to an upper hub 24, attached to an uppermost end of the support pole 12. In addition, a plurality of struts 26 are pivotally connected to the lower hub 20, as at 28, at their inner most end, with an outermost end of the struts 26 being movably connected to individual ones of the ribs 22. Due to the cooperative structuring and movable interconnection between the operative components, including the plurality of ribs 22 and the plurality of struts 26, the umbrella canopy 16 is activated for movement between the aforementioned opened and closed orientations, by movement 100 of the lower hub 20 in either an upward or downward direction, along the length of the pole 12.

It is emphasized that FIGS. 1 and 2 illustrate only one type of umbrella 10 assembly with which the support assembly of the present invention, when embodied in the support pole 12, may be utilized. More specifically, the support assembly 12 of the present invention is suitable for use with other types of umbrellas, with a central support pole or other supporting structure, and is also suitable for use with outdoor furniture including support structures such as but not limited to cabanas, chairs, tables, sofas and chaises. It is also emphasized that the structural and operative features associated with the umbrella assembly 10, as illustrated in FIGS. 1 and 2, are representative only, and do not comprise the only structural features or the precise structural features associated with an umbrella assembly, with which the support pole 12 of the present invention may be utilized.

Accordingly, and in at least one embodiment, the present invention is directed to the support assembly in the form of and defining a support pole 12 for an outdoor umbrella assembly 10 of the type having an umbrella canopy 16, a hub 20 and other associated components, such as but not limited to the type represented in FIGS. 1 and 2. It is also to be noted that as used herein, the terms "canopy activating hub", "activation of the canopy" and similar and/or substantially equivalent terminology refers to the canopy 16 being disposed between an outwardly extending, expanded and open orientation and an inwardly disposed, collapsed and closed orientation. As such, activating disposition of the canopy 16 between the open and closed orientations is accomplished by movement of the hub 20 upwardly or downwardly along a portion of the length of the support pole 112. Therefore, movement 100 of the hub 20 relative to the support pole 112 in this manner accurately describes the "canopy activating hub" and/or "activation of the canopy".

With reference now to FIGS. 3, 3A and 4-6, illustrated is a section of a support assembly/support pole 12 having an elongated body 30 which preferably extends along the entire length of the support pole 12. Further, the elongated body 30 may be formed of a metal material, combination of metal materials, aluminum, or other material having sufficient strength and rigidity to support the umbrella canopy 16, hub 20, and the associated operative components 22-28, or their equivalents, as represented in FIG. 2. The elongated body 30 may by formed by extrusion or another manufacturing techniques suitable for use with the selected material(s). Additionally, and as best shown in FIGS. 3, 3A-6, the elongated body 30 will have an outer surface 32 which, in at least one embodiment, comprises a generally cylindrical configuration, and further, may also include a hollow interior.

Figure 3:
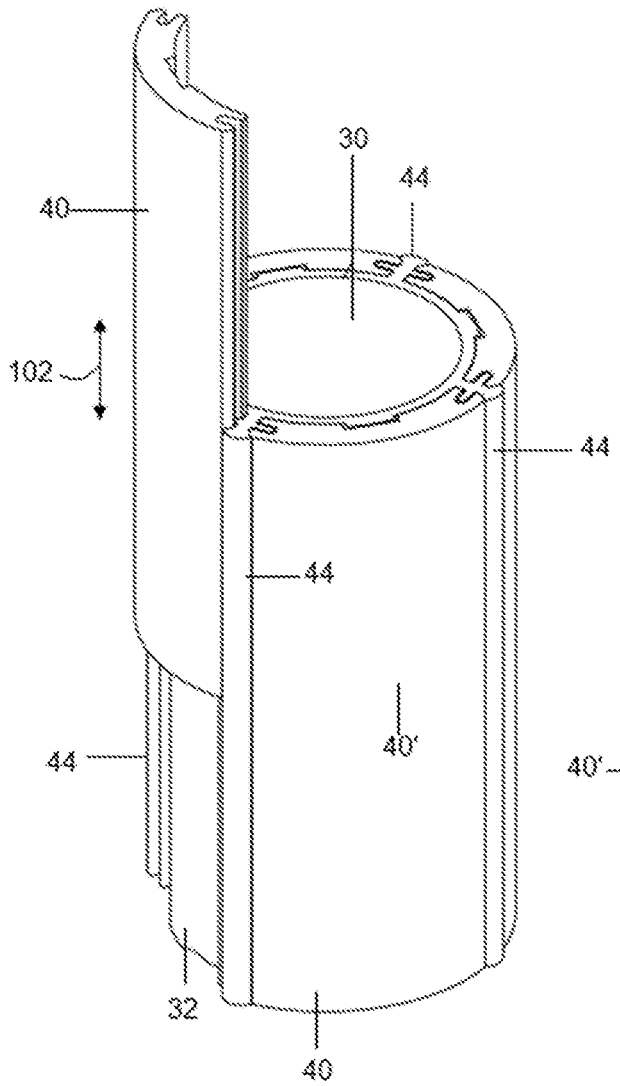
FIG. 3 is a perspective view in section of the support assembly of the present invention in at least partially assembled form.
Figure 4:
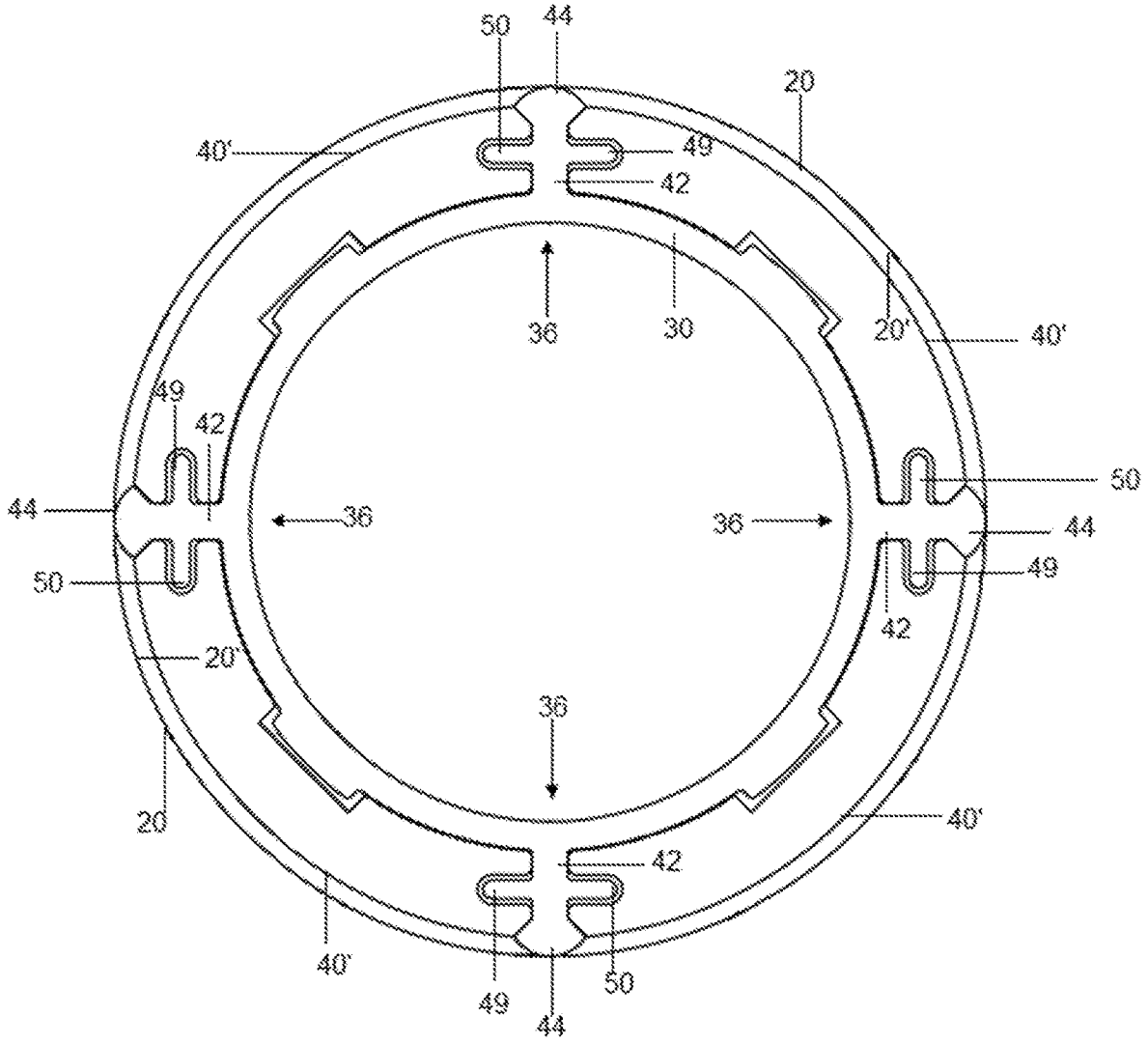
FIG. 4 is a transverse sectional view of the embodiment of FIGS. 3 and 3A.
Figure 5:
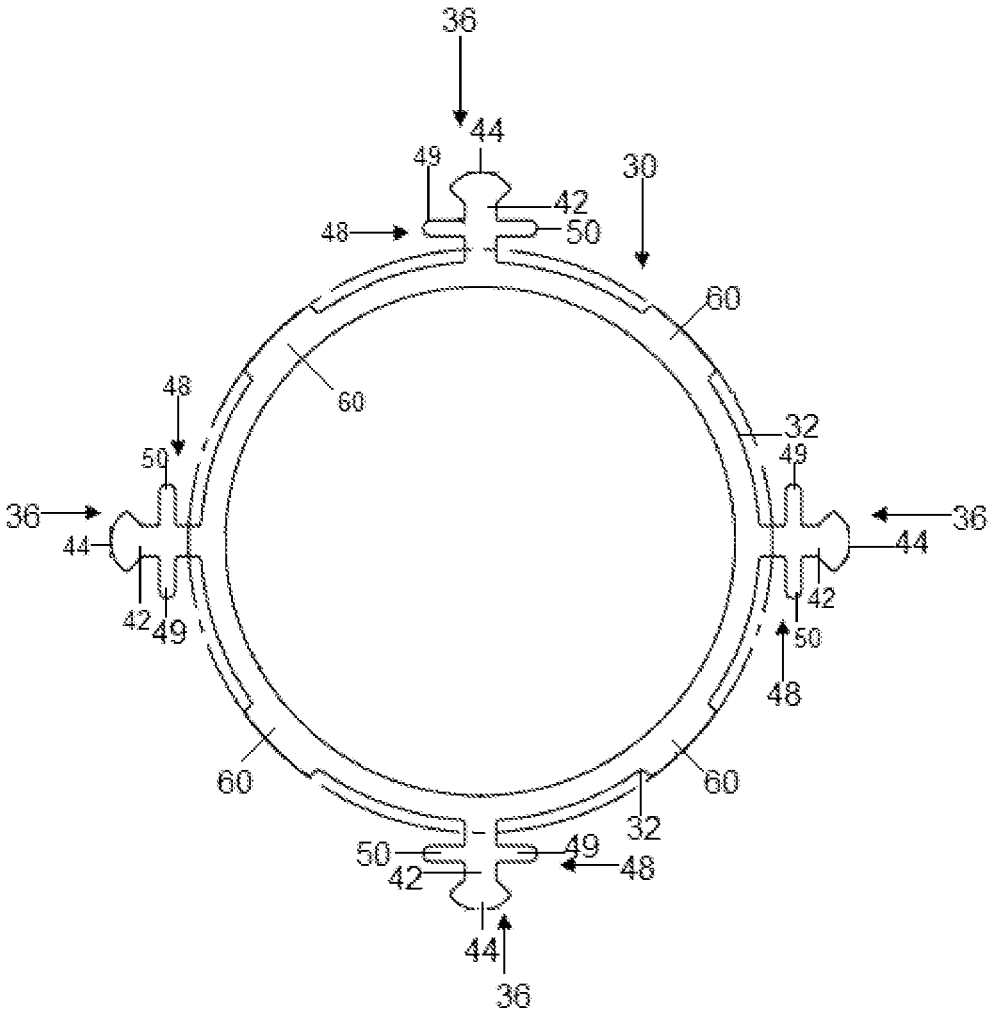
FIG. 5 is a detail, transverse sectional view of the embodiment of FIG. 4.

Referring now to FIG. 5, the elongated body 30 of the present invention can include a plurality of connector structures 36 that extend radially outwardly from the outer surface 32 thereof. Each of the connector structures 36 may be integrally or fixedly secured to the elongated body 30, and as illustrated, may be disposed in spaced relation to one another in outwardly, collectively surrounding relation to the body 30. In at least one embodiment, and for reasons described in further detail herein, the plurality of connector structures 36 are preferably, but not necessarily, equally spaced from one another. Also, while the plurality of connector structures 36 are represented in FIGS. 3 through 6 as being four in number, the actual number may vary and may be more practically defined by the outer dimensions of the elongated body 30 of the support pole 12 (or other structure). Moreover, the cooperative structuring between the plurality of connector structures 36 and the elongated body 30, if formed to be integral therewith, should also serve to strengthen a support pole 12.

With reference again to FIGS. 3, 3A and 4, the present invention additionally comprises at least one, but preferably and more practically, a plurality of inserts 40 operatively disposed in overlying relation to the outer surface 32 of the elongated body 30. When operatively disposed in the manner represented in at least FIGS. 3 and 3A, the one or more inserts 40 at least partially define an outer facing of the support pole 12. Moreover, the operative disposition of the one or more inserts 40 on the body 30 is accomplished by interconnection with the plurality of connector structures 36 and being slidably disposed into abutting relation on the elongated body 30. The present invention contemplates that the plurality of inserts 40 can be formed from a variety of different materials, whether in whole or in part. The different types of materials can include, but is not limited to various types of wood, wood veneers, metals, chrome, plastic, composites, polymers, etc. which may be highly decorative and aesthetically pleasing. Therefore, when a plurality of inserts 40 are disposed in an operative disposition overlying, covering the outer surface 32 of the elongated body 30, as represented in at least FIGS. 3 and 3A, they may be formed of a common material and have a substantially common decorative appearance, for instance to give the appearance that the support pole 12 is formed from a nearly solid piece of wood. Alternatively, each of the plurality of inserts 40 may have somewhat different or individualized decorative appearances, thereby enhancing the versatility of the aesthetics of the support pole 12. As another example, the inserts 40 may include wood veneer on alternating ones with a chrome or decorative metal or plastic material formed on the intervening inserts.

As set forth above, the plurality of connector structures 36 may be evenly spaced from one another in collectively surrounding relation to the elongated body 30. In cooperation therewith, each of the plurality of inserts 40 may also have a substantially common transverse dimension, substantially equal to the spacing between adjacent ones of the plurality of connector structures 36 in order to realize reduced production costs. More specifically, the cost of producing the plurality of inserts 40 may be reduced, in embodiments where they have at least partially common dimensions and/or configurations. The ability to have at least partially common dimensions and/or configurations is due, at least in part, to the equal spacing between the connector structures 36, as set forth above.

Figure 3A:
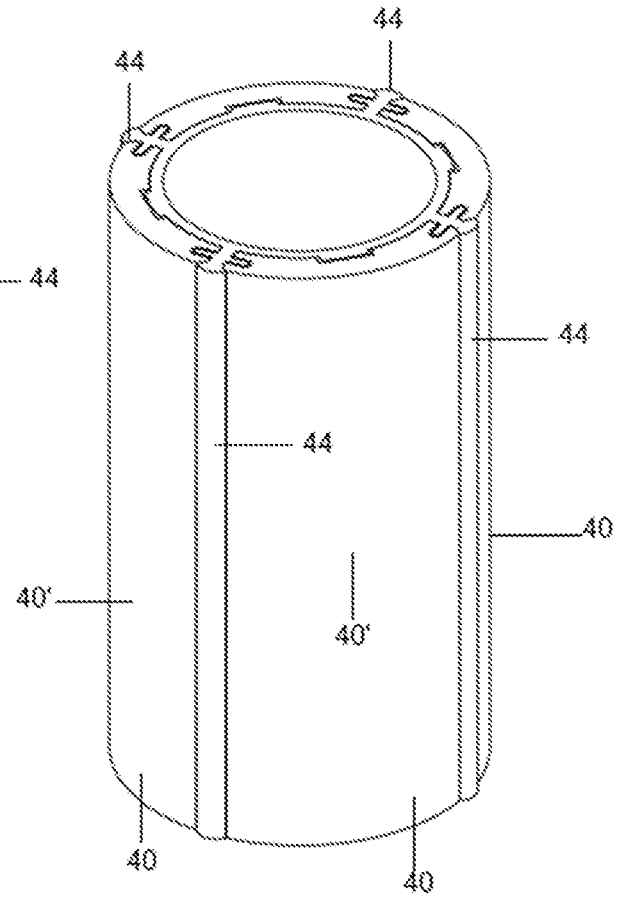
FIG. 3A is a perspective view in section of the embodiment of FIG. 3 in an assembled form.

Also, in accordance with the present invention, each of the plurality of connector structures 36 will preferably be cooperatively dimensioned, configured and structured to include engaging portions for interconnection with the plurality of inserts 40. For example, and as best shown in FIGS. 4 and 5, in at least one embodiment, the connector structures 36 include a primary segment 42 extending radially outward from the elongated body 30. Further, the longitudinal dimension of the primary segment 42 is such as to dispose an outer, distal end 44, outwardly and away from the surface 32 of the body 30 (shown in FIGS. 3, 3A and 5) and also outwardly from the exposed surface 40' of the one or more inserts 40. In at least one embodiment, the primary segment 42 associated with one or more of the plurality of connector structures 36 preferably also includes a lateral segment 48 integrally connected to the primary segment 42 and extending transversely outward therefrom. Preferably, each lateral segment 48 associated with a connecting structure 36 is cooperatively disposed, dimensioned and configured to movably engage and retain a correspondingly disposed peripheral edge, generally indicated as 54 in FIG. 6, of the one or more inserts 40 being removably mounted in an operative position on the body 30, as represented in FIGS. 3 and 3A. Such cooperative structuring between the lateral segment 48 and the corresponding peripheral edges 54 of the inserts 40 may be at least partially defined by a movable tongue and groove connection, as represented in detail in at least FIGS. 5 and 6.

Figure 6:
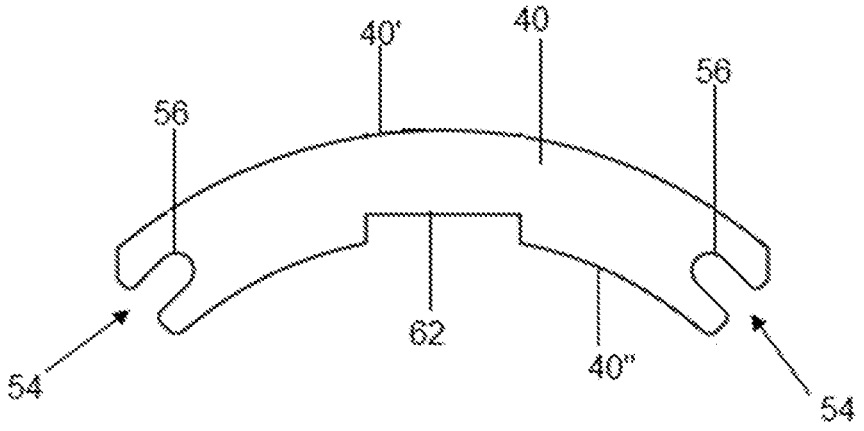
FIG. 6 is a detail transverse sectional view of an insert component as represented in the embodiments of FIGS. 3, 3A and 4.

More specifically, and with reference to the illustrated embodiment of FIG. 5, each of the lateral segments 48 include two sections or "tongues" 49 and 50, disposed in colinear relation to one another, extending transversely outward from the length of the primary segment 42, in opposite directions. Each of these sections or tongues 49 and 50 are cooperatively disposed, dimensioned and configured to be movably received within elongated grooves 56, integrally formed in the peripheral edges 54 of each of the one or more inserts 40, as shown in FIG. 6. Accordingly, a movable tongue and groove connection, defined by one of the tongues 49 or 50 being movably disposed in retaining engagement within a correspondingly disposed one of the grooves 56, serves to define the aforementioned "tongue and groove" connection. Also, each of the tongues 49 and 50 may be equivalently structured thereby facilitating tongues 49 and 50 of the adjacent but spaced apart connectors 36 being movably and removably connected to a common insert 40. Similarly, adjacent ones of the inserts 40 may be partially connected to the body 30 by tongues 49 and 50 of a common connector structure 36 being connected to peripheral edges 54 of different, adjacent ones of the plurality of inserts 40.

Moreover, the movable "tongue and groove" connection is structured to removably interconnect each of the one or more inserts 40 in the intended operative position, in overlying relation to an outer surface 32 of the elongated body 30 of the support pole 12. The sliding or movable and removable structuring facilitated by the aforementioned tongue and groove connection is schematically represented by directional arrow 102 in FIG. 3. As also set forth above, the movable and removable connection of the one or more inserts 40 in the operative position, overlying the outer surface 32 of the body 30, facilitates removal and/or replacement of each of the one or more inserts 40. Such removal and replacement may be the result of damage to the one or more inserts 40 or a desire to change the decorative appearance of the support pole 112.

As indicated, the length of the support pole 12 may extend from a base 14 at its lower end to supporting attachment with an umbrella canopy 16 at its upper end, as discussed in detail with reference to FIGS. 1 and 2. Further, the plurality of inserts 40 and the plurality of connector structures 36 may also extend along at least a majority of a length of the support pole 12 and in some instances, almost along the entirety of the length thereof. However, it is emphasized that due to the possibility of removal of the plurality of inserts 40, for the reasons set forth in greater detail hereinafter, the plurality of inserts 40 and the plurality of connector structures 36 may extend along a length of the support pole 12 substantially equal to or in the alternative somewhat less than the length of the path of travel of the hub 20 along the support pole 12 as it activates the canopy 16 between the aforementioned open and closed orientations. In some practical applications, it is recognized that in order to remove one or more of the plurality of inserts 40 from between the plurality of connectors 36, the hub 20 may have to be disposed and/or forced into a position which does not cover or overlie the one or more inserts 40.

With reference again to FIG. 4, as well as to FIG. 2, another feature of the support pole 12 is its interaction with the hub 20 as it moves along a length of the support pole 12 during activation of the canopy 16 between the open and closed orientations. More specifically, and as indicated, the distal end 44 of each of the primary segments 42 extends outwardly from the outer surface 40' of adjacent ones of the inserts 40. As a result, when the umbrella canopy 16 is activated due to the movement, upwardly or downwardly, of the hub 20 along a length of the support pole 12, the distal ends 44 of the plurality of connector structures 36 will movably engage the inner surface of the hub 20, which is schematically represented as 20' in FIG. 4. Therefore, the hub 20 and its inner surface 20' will be continuously spaced outwardly from the exposed surface 40' of the plurality of inserts 40. This outward disposition of the hub 20 relative to the exposed surfaces 40' of the plurality of inserts 40, during movement of the hub to activate the umbrella canopy 16 between open and closed orientations, is beneficial and should prevent any direct contact between the inner surface 20' of the hub 20 and the outer, exposed surface 40' of the plurality of inserts 40. As a result, what might otherwise be scratching of, abrasive engagement with, or similar damage to the decorative and outer surfaces 40' of the plurality of inserts 40 should be completely eliminated or significantly restricted, during movement of the hub 20 along the length of the support pole 12.

With reference now to FIGS. 5 and 6, in at least one embodiment of the present invention, the elongated body 30 may further include at least one mounting segment 60 integrally formed in the side wall thereof. As shown, this mounting segment 60 may have a greater thickness than other portions of the corresponding sidewall, between adjacent connector structures 36. The increased thickness, structure and placement of the mounting segment 60 allow for drilling, cutting, or other formation of the elongated body 30 and its profiled sidewalls which in turn, enables attachment of a variety of different decorative structures such as inserts 40 to the body 30. In cooperation therewith, and as shown in FIG. 6, an inner surface 40" of the one or more inserts 40 may include an elongated recess 62 formed therein. The elongated recess 62 is cooperatively dimensioned, configured and disposed to receive the mounting segment 60 therein, concurrent to the corresponding insert 40 being disposed in its operative position, overlying the exterior surface 32 of the elongated body 30.

Since many modifications, variations and changes in detail can be made to the described preferred embodiment of the invention, it is intended that all matters in the foregoing description and shown in the accompanying drawings be interpreted as illustrative and not in a limiting sense. As just one example, the present invention has been described primarily relative to use on a central support pole for an umbrella assembly, but this invention is also particularly well suited for use with other support structures, such as vertical columns used to form an outdoor cabana, or outdoor furniture, such as chair legs, chair arms, table legs, and the like. Thus, the scope of the invention should be determined by the appended claims and their legal equivalents.

What is claimed is:

1. A support assembly structured for indoor and outdoor use, said support assembly comprising:

a body including an elongated configuration, a plurality of connector structures mounted on said body and extending outwardly therefrom in spaced relation to one another, at least one insert disposed in overlying relation to an outer surface of said body, adjacent ones of said plurality of connector structures interconnecting said at least one insert in said overlying relation each of said adjacent connector structures including a primary segment and a lateral segment; said lateral segment secured to said primary segment, said primary segment secured to said body and extending outwardly from an exterior surface thereof beyond an outer surface of said at least one insert, and opposite peripheral edges of said at least one insert including a groove formed therein; said grooves cooperatively configured with said lateral segments of said adjacent ones of said plurality of connectors, to define a movable and removable tongue and groove connection therebetween.

2. The support assembly as recited in claim 1 wherein each of said lateral segments of said adjacent ones of said plurality of connector structures is concurrently disposed in supporting engagement with said at least one insert.

3. The support assembly as recited in claim 1 wherein each of said adjacent ones of said plurality of connectors includes said primary segment having a distal end disposed outwardly from said at least one insert, concurrent to said lateral segment thereof disposed in said movable and removable tongue and groove connection therebetween.

4. The support assembly as recited in claim 1 further comprising a plurality of inserts; said plurality of connector structures connecting said plurality of inserts in overlying relation to correspondingly disposed sections of said outer surface of said elongated body.

5. The support assembly as recited in claim 4 wherein each of said plurality of connector structures comprises a primary segment and a lateral segment, said primary segment integrally secured to said body and extending radially outward therefrom; each of said lateral segments extending laterally outward from a respective one of said primary segments in connected engagement with correspondingly positioned, adjacent ones of said plurality of inserts.

6. The support assembly as recited in claim 5 wherein opposite peripheral edges of each of said plurality inserts include a groove formed therein; said grooves cooperatively configured with said lateral segment of adjacent ones of said plurality of connectors to define a removable tongue and groove connection therebetween.

7. The support assembly as recited in claim 1 wherein said elongated body comprises a sidewall having at least one mounting segment, said at least one mounting segment including a greater thickness than a remainder of said sidewall.

8. The support assembly as recited in claim 7 wherein said at least one insert includes a recess, said at least one mounting segment disposed within said recess concurrent to disposition of said at least one insert in said overlying relation.

9. The support assembly as recited in claim 1 wherein said lateral segment comprises at least two collinear tongues extending transversely outward from said primary segment in opposite directions.

10. The support assembly as recited in claim 9 wherein said tongue and groove connection is further defined by each of said at least two tongues disposed within a different one of said groups of adjacent ones of said plurality of inserts.

11. A support assembly structured for integration in an umbrella assembly having a canopy activating hub, said support assembly comprising:

a body having an elongated configuration and defining a support pole of the umbrella assembly, a plurality of spaced apart connector structures connected to said body in collectively surrounding relation thereto, a plurality of inserts; said plurality of connector structures connecting said plurality of inserts in overlying relation to an outer surface of said body, and each of said plurality of connector structures including a primary segment and a lateral segment; said primary segment secured to said elongated body and said lateral segment secured to said primary segment, opposite peripheral edges of each of said plurality of inserts including a groove formed therein; said grooves cooperatively configured with said lateral segments of adjacent ones of said plurality of connectors, to define a movable and removable tongue and groove connection therebetween, said plurality of connector structures and said plurality of inserts extend along a length of said body equivalent to at least a majority of a path of travel of the hub on said body, concurrent to activation of the canopy, and said plurality of connector structures include a distal end disposed in outwardly spaced relation to said plurality of inserts in movable engagement with the hub, concurrent to activation of the canopy.

12. The support assembly as recited in claim 11 further comprising said primary segment integrally secured to said body and including said distal end extending outwardly from said elongated body and said plurality of inserts in a visually observable disposition; each of said lateral segments extending laterally outward from a respective one of said primary segments in connected engagement with adjacent, correspondingly positioned ones of said plurality of inserts.

13. The support assembly as recited in claim 11 wherein said lateral segment of adjacent ones of said plurality of connectors are disposed in connecting engagement with a common one of said plurality of inserts.

14. The support assembly as recited in claim 11 wherein said body comprises a sidewall having at least one mounting segment, said at least one mounting segment including a greater thickness than a remainder of said sidewall; at least one of said plurality of inserts includes a recess, said at least one mounting segment disposed within said at least one recess concurrent to disposition of said at least one insert in said overlying relation.

15. The support assembly as recited in claim 11 wherein said lateral segment comprises at least two collinear tongues extending transversely outward from said primary segment in opposite directions.

16. The support assembly as recited in claim 15 wherein said tongue and groove connection is further defined by each of said at least two tongues disposed within a different one of said groups of adjacent ones of said plurality of inserts.

* * * * *